US006741036B1

(12) United States Patent
Ikedo et al.

(10) Patent No.: US 6,741,036 B1
(45) Date of Patent: May 25, 2004

(54) GAS DISCHARGE TUBE

(75) Inventors: Tomoyuki Ikedo, Shizuoka-ken (JP); Kouzou Adachi, Shizuoka-ken (JP); Yoshinobu Ito, Shizuoka-ken (JP); Ryotaro Matui, Shizuoka-ken (JP)

(73) Assignee: Hamamatsu Photonics, K.K., Shizuoka-ken (JP)

( * ) Notice: Subject to any disclaimer, the term of this patent is extended or adjusted under 35 U.S.C. 154(b) by 460 days.

(21) Appl. No.: 09/688,927

(22) Filed: Oct. 17, 2000

Related U.S. Application Data

(63) Continuation-in-part of application No. PCT/JP98/05818, filed on Dec. 22, 1998.

(30) Foreign Application Priority Data

Sep. 7, 1998 (JP) ..... 10-252589
Sep. 7, 1998 (JP) ..... 10-252595

(51) Int. Cl.[7] ..... H01J 17/04
(52) U.S. Cl. ..... 313/634; 313/613; 313/614
(58) Field of Search ..... 313/634, 613, 313/614, 615, 239, 292, 592, 593, 594, 595, 581–588, 623, 308

(56) References Cited

U.S. PATENT DOCUMENTS 2,071,597 A 2/1937 Vasselli
2,151,809 A 3/1939 Shardlow
5,633,563 A * 5/1997 Ikedo et al. ..... 313/614

FOREIGN PATENT DOCUMENTS

| | | |
|---|---|---|
| JP | 51-94291 | 8/1976 |
| JP | 61-251723 | 11/1986 |
| JP | 61-15734 | 8/1994 |
| JP | 7-326324 | 12/1995 |
| JP | 8-77965 | 3/1996 |
| JP | 8-77969 | 3/1996 |
| JP | 8-77979 | 3/1996 |
| JP | 7-222185 | 8/1996 |
| JP | 8-222186 | 8/1996 |
| JP | 8-236081 | 9/1996 |

* cited by examiner

*Primary Examiner*—Vip Patel
*Assistant Examiner*—Ken A Berck
(74) *Attorney, Agent, or Firm*—Morgan, Lewis & Bockius LLP

(57) ABSTRACT

A flange portion is integrally formed with a stem which forms a sealing envelope for a gas discharge tube. Accordingly, operation for building and fixing the flange portion is not necessary, so that lamp assembly operation is simplified, and mass production is facilitated. In addition, when a gas discharge tube is to be fixed to an external stem setting portion, lamp setting is enabled at higher precision by utilizing positioning holes formed in the flange portion in advance.

10 Claims, 8 Drawing Sheets

GAS DISCHARGE TUBE

RELATED APPLICATION

This is a continuation-in-part application of international application serial no. PCT/JP98/05818 filed on Dec. 22, 1998, now pending.

BACKGROUND OF THE INVENTION

1. Field of the Invention

The present invention relates to a gas discharge tube; and, more particularly, to a gas discharge tube for use as a light source for a spectroscope, chromatography, or the like.

2. Related Background Art

As a conventional technique of this field, one disclosed in Japanese Patent Laid-Open No. 7-326324 is available. As shown in FIG. 9, a gas discharge tube (deuterium lamp) 100 described in this reference has a glass sealing envelope 101, and a light emitting part assembly 102 is held in the sealing envelope 101 in a floating state. The light emitting part assembly 102 is comprised of an anode plate 105 sandwiched by ceramic support plates 103 and 104, a cathode section 106 located above the anode plate 105, and a converging electrode plate 107 arranged between the anode plate 105 and cathode section 106. To use this discharge lamp, a predetermined voltage is applied to the anode plate 105, cathode section 106, and converging electrode plate 107 to cause arc discharge above a converging opening 107*a* of the converging electrode plate 107, and light generated by arc discharge is emitted outside through a light projecting window 101*a* of the sealing envelope 101. Emitted light is guided to an optical system for focusing the light or transmitting it through a fine slit. In order to increase the light use efficiency, a portion having the highest light intensity, i.e., the emission central point, must be set on the optical path. The lamp 100 must be reliably set at a predetermined position of a lamphouse 108 and the emission central point must be accurately positioned. For this purpose, in this conventional apparatus, a flange member 109 as a separate component is fixed to the lamp 100 through an adhesive R, so that the lamp 100 can easily be set in a lamp accommodating recess 110 of the lamphouse 108. To fix the flange member 109 by adhesion, the flange member 109 is aligned with the emission central point of the lamp 100 while observing it, and the flange member 109 is fixed to the outer surface of the sealing envelope 101. When setting the lamp 100 in the lamphouse 108, set screws 111 provided in the lamp accommodating recess 110 are inserted through screw insertion holes 112 in the flange member 109, and the lamp 100 is fixed to the lamphouse 108 by using the set screws 111 and nuts 113. Stem pins 114 of the lamp 100 are inserted in a socket 115, thereby setting the lamp 100. Hence, the emission central point can be arranged on a predetermined optical path.

SUMMARY OF THE INVENTION

The conventional gas discharge tube described above suffers the following problems. The flange member 109 is a component separate with respect to the lamp 100, and is fixed to the lamp 100 through the adhesive R. As a result, the positional relationship between the flange member 109 and the emission central point of the lamp 100 may undesirably change while the adhesive R is set. It takes time to adhere the flange member 109. Even if the emission central point and the flange member 109 of the lamp 100 are precisely aligned with each other, when setting the lamp 100 in the lamp accommodating recess 110, the screw insertion holes 112 are not suitable for high-precision alignment as they are holes in which the set screws 111 are to be inserted. Alignment of the emission central point of the lamp 100 must accordingly be performed depending on the skill of the operator or a predetermined adjusting jig. Therefore, the lamp 100 cannot be positioned in the lamp accommodating recess 110 easily and reliably at high precision.

The present invention has been made to solve the above problems, and has as its object to provide a gas discharge tube in which an assembling workability and an attaching precision with respect to an optical system are improved.

In order to solve the above problems, according to the present invention, there is provided a gas discharge tube in which a gas is sealed in a sealing envelope at least part of which can transmit light, and discharge is caused between an anode section and a cathode section arranged in the sealing envelope, so that predetermined light is emitted through a light transmitting portion of the sealing envelope. This sealing envelope comprises a stem for securing the cathode and anode sections by way of respective stem pins independent from each other, and a side tube, at least part of which is made of a light transmitting material, surrounding the cathode and anode sections and being joined to the stem. Wherein the stem has an integrally formed flange portion extending in a direction perpendicular to an axial direction of the side tube and having a positioning reference portion when attaching the gas discharge tube to an external fixing member.

In this gas discharge tube, since the flange portion is integrally formed with the stem, operation for constructing and fixing the flange portion is not necessary when assembling the lamp, so that lamp assembly operation is simplified, and mass production is facilitated. In addition, since the positioning reference portion is positively formed on the flange portion integrated with the stem, lamp setting is enabled at higher precision.

The gas discharge tube preferably further comprises an anode support plate in contact with a surface of the stem which is inside the sealing envelope, and supporting the anode section on an opposite surface thereof, a ceramic spacer in contact with an exposed surface of the anode support plate and having an opening for exposing the anode section therethrough, and a converging electrode plate in contact with the exposed surface of the spacer to oppose the anode section and having a converging opening coaxial with the opening of the spacer, the converging electrode plate being made of a conductive member.

When this arrangement is employed, since the stem, the anode support plate, the spacer, and the converging electrode plate are stacked to be in contact with each other, heat generated by the anode section or converging electrode plate can be radiated outside through the stem 4. Hence, the stem functions as a heat sink. In assembly, the positional relationship between the stem and the converging electrode plate can be regulated at high precision with the simple assembly operation of stacking the respective constituent members on the stem. This contributes to alignment of the emission central point with the flange portion integrated with the stem.

The positioning portion preferably has a positioning hole or notch for inserting a positioning pin inserted another end in a positioning hole formed in a stem setting portion of an external fixing member where the gas discharge tube is to be attached, or a positioning pin standing upright from the stem setting portion. In this case, positioning that keeps a relationship between the pin and hole is enabled, and setting is enabled at high precision by a simple structure in which merely a positioning pin, a positioning hole, or a notch portion is formed in the flange portion.

Alternatively, the positioning portion preferably has a projecting portion projecting from the flange portion laterally or a cut-off portion formed on an outer surface of the flange portion so as to conform to a shape of a stem setting portion of the external fixing member to which the gas discharge tube is to be mounted. Alternatively, the flange portion may have an outer shape of a predetermined polygon. In this case, the outer shape of the flange portion itself is a characteristic feature. As a result, the flange portion can cope with use situations in various manners with the shape of the projecting portion or the cut-off portion, or by changing its outer diameter itself, so that lamp setting is enabled at high precision with a simple arrangement.

The present invention can be understood more sufficiently through the detailed description and accompanying drawings which follow. Note that the detailed description and accompanying drawings are shown merely for illustrative examples and should not be construed to limit the present invention.

Further application of the present invention will become apparent from the following detailed invention. Although the detailed description and specific examples show preferable embodiments of the present invention, they are shown merely for illustrative examples. Various modifications and improvements in the spirit and scope of the present invention are naturally apparent to one skilled in the art from the detailed description.

DETAILED DESCRIPTION OF PREFERRED EMBODIMENTS

Figure 1:
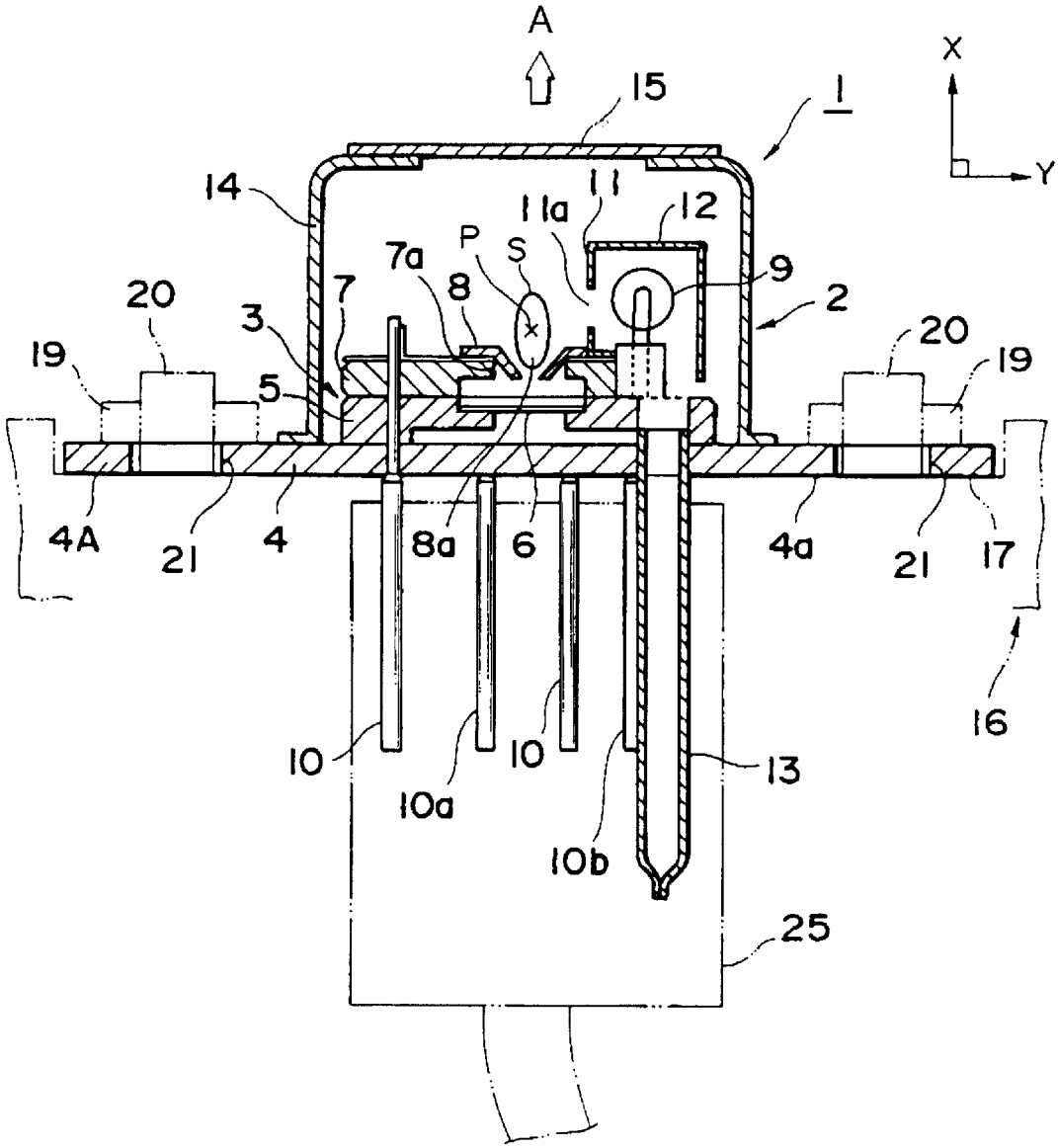
FIG. 1 is a sectional view showing a gas discharge tube according to the first embodiment of the present invention.

Gas discharge tubes according to the preferable embodiments of the present invention will be described in detail with reference to the accompanying drawings. To facilitate the comprehension of the explanation, the same reference numerals denote the same parts, where possible, throughout the drawings, and a repeated explanation will be omitted.

FIG. 1 is a sectional view showing a deuterium lamp as a gas discharge tube according to the first embodiment of the present invention. A deuterium lamp 1 shown in FIG. 1 is a head-on-type deuterium lamp. This deuterium lamp 1 has a sealing envelope 2 in which deuterium gas is sealed at about several Torr. A light emitting part assembly 3 is housed in the sealing envelope 2. The light emitting part assembly 3 has a ceramic anode support plate 5 arranged on a stem 4 in contact with it. An anode plate 6 is arranged on the anode support plate 5 so the anode plate 6 is separate from the stem 4. The anode plate 6 is fixed by welding to the upper end of a stem pin 10*a* fixed to extend through the stem 4.

A ceramic spacer 7 is arranged on the anode support plate 5 such that they sandwich the anode plate 6. A converging electrode plate 8 is arranged on the spacer 7 in contact with it. An converging opening 8*a* formed in the converging electrode plate 8 opposes an opening 7*a* of the spacer 7, and the converging electrode plate 8 and anode plate 6 are set to oppose each other. In this manner, since the stem 4, anode support plate 5, spacer 7, and converging electrode plate 8 are stacked in contact with each other, heat generated by the anode plate 6 or converging electrode plate 8 can be conducted and radiated outside through the anode support plate 5, spacer 7, and stem 4. Hence, the stem 4 serves as a heat sink. The positional relationship between the stem 4 and converging electrode plate 8 is defined at high precision. This contributes to positioning the converging opening 8*a* with respect to the stem 4.

On a side of the converging opening 8*a*, a cathode section 9 located above the spacer 7 is provided. The cathode section 9 is fixed by welding to the upper end of a stem pin 10*b* fixed to extend through the stem 4, and generates thermions as a voltage is applied to it. A discharge straightening plate 11 is provided between the cathode section 9 and converging opening 8*a* at a position away from an optical path (immediately above the converging opening 8*a* in FIG. 1, i.e., formed in a direction of an arrow A). The discharge straightening plate 11 is formed with a rectangular open electron emission window 11*a* for allowing thermions emitted from the cathode section 9 to pass therethrough. The discharge straightening plate 11 is fixed to the upper surface of the converging electrode plate 8 by welding. The discharge straightening plate 11 is provided with a cover plate 12 having an L-shaped section so as to surround a portion above the cathode section 9 and a portion on a side opposite to the electron emission window 11*a*, which is behind the cathode section 9. The cover plate 12 prevents a sputtering substance or evaporated substance produced from the cathode section 9 from attaching to a light projection window 15 made of silica glass or ultraviolet ray transmitting glass.

The light emitting part assembly 3 having this arrangement is set in the sealing envelope 2. In order to fill the sealing envelope 2 with deuterium gas of several Torr, an exhaust tube 13 is fixed to the stem 4. By utilizing the exhaust tube 13, air in the sealing envelope 2 can be evacuated once, and after that deuterium gas having a predetermined pressure can be filled in the sealing envelope 2. After filling, the exhaust tube 13 is closed as shown in FIG. 1, thereby sealing the sealing envelope 2. The sealing envelope 2 has a Koval metal side tube 14 resistance-welded to the upper surface of the stem 4. The light projection window 15 made of UV transmitting glass is fixed to the top portion of the side tube 14. Alternatively, the side tube 14 may be entirely made of glass, so that the top portion of the side tube 14 functions as the glass light projection window 15.

Figure 2:
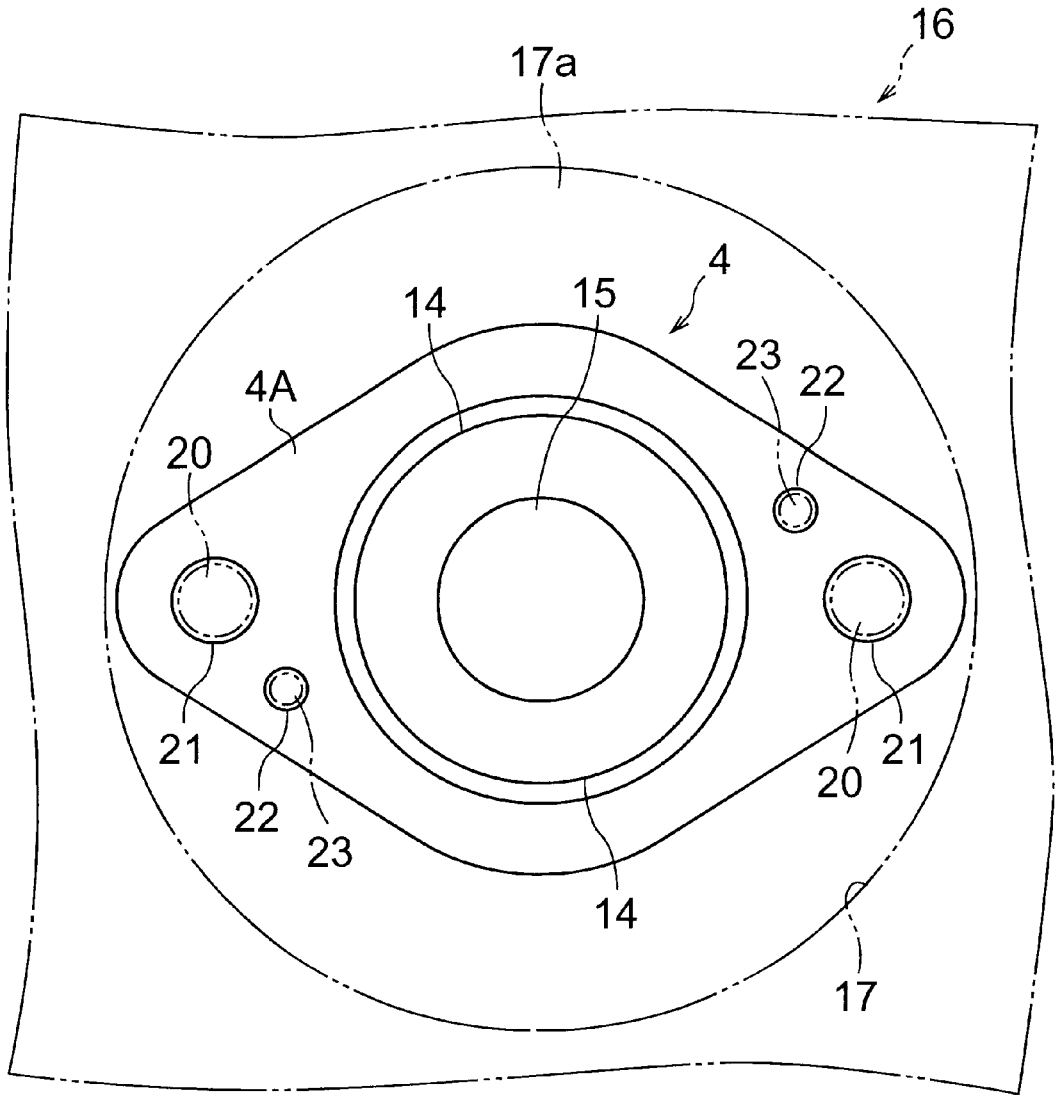
FIG. 2 is a plan view of the same.

The stem 4 is made of Koval metal, and formed into an almost rhombic flat plate with an overhang-molded flange portion 4A, as shown in FIGS. 1 and 2. The flange portion 4A extends in a direction perpendicular to the axial direction of the side tube 14, and is integrally formed with the stem 4. The stem 4 is utilized as the reference position with respect to the light emitting part (a-portion before the converging opening 8*a* where an arc ball S is produced) of the deuterium lamp 1. More specifically, the stem 4 is assembled such that an emission central point P (x mark) of the arc ball S keeps a predetermined distance from a bottom surface 4*a* of the flange portion 4A. This allows the lamp utilizing the stem 4 to be mounted as it is positioned at high precision.

This stem 4 is housed in a cavity-like stem setting portion 17 formed in a lamphouse 16. In this case, the bottom surface 4*a* of the stem 4 is abutted against a support surface 17*a* of the stem setting portion 17. A pair of right and left attaching screws 20 extend vertically upward from the support surface 17*a*, and screw insertion holes 21 are formed in the flange portion 4A of the stem 4 at positions corresponding to the respective attaching screws 20. Hence, when setting the lamp 1 in the lamphouse 16, the attaching screws 20 are inserted in the screw insertion holes 21 of the flange portion 4A, the bottom surface 4*a* of the stem 4 is abutted against the support surface 17*a* of the stem setting portion 17, and after that the lamp 1 is firmly fixed to the lamphouse 16 by using the attaching screws 20 and nuts 19. In mounting the lamp, the position of the emission central point P is positioned correctly in an axial direction X but incorrectly in a direction Y perpendicular to the axis. This results from the magnitude of the tolerance of the screw insertion holes 21 themselves.

In order to achieve positioning of the lamp 1 in the Y direction, positioning holes 22 as an example of a positioning reference portion are formed in the flange portion 4A of the stem 4. Positioning pins 23 stand upright from the support surface 17*a* to correspond to the positioning holes 22. Highly precise positioning not depending on the attaching screws 20 and screw insertion holes 21 is enabled by increasing the fitting precision between the positioning holes 22 and positioning pins 23. In this case; positioning that maintains the relationship between the pins and holes is enabled. A simple structure wherein merely the positioning holes 22 are formed in the flange portion 4A enables highly precise lamp setting. Reference numeral 25 in FIG. 1 denotes a bayonet socket for supplying a predetermined voltage to a stem pin 10.

The operation of the deuterium lamp 1 described above will be briefly explained. First, a power of about 10 W is supplied from an external power supply to the cathode section 9 for about 20 sec to preheat it. After that, a DC open voltage of about 150 V is applied across the cathode section 9 and anode plate 6 to prepare for arc discharge.

When this preparation is completed, a trigger voltage of about 350 V to 500 V is applied across the cathode section 9 and anode plate 6. In this case, thermions emitted from the cathode section 9 converge through the converging opening 8*a* of the converging electrode plate 8 while being straightened by the discharge straightening plate 11, and reach the anode plate 6. Arc discharge occurs before the converging opening 8*a*. Ultraviolet rays obtained from the arc ball S because of this arc discharge are transmitted through the light projection window 15 to be emitted outside. When the emission central point P (x mark) is located on the focal point of a reflecting mirror (not shown), the light intensity of ultraviolet rays coming incident on a light-receiving object (e.g., an optical slit of about 50 $\mu$m to 100 $\mu$m in a spectrophotometer) can be increased to the maximum.

The present invention is not limited to the embodiment described above, but various modifications can be made. For example, the gas to be filled in the sealing envelope is not limited to deuterium gas, but various types of discharge gases such as mercury gas, helium gas, and neon gas, emission of which can be utilized upon arc discharge, can be used. Various types of embodiments are possible as the positioning reference portion. Some of these embodiments will be described.

Figure 3:
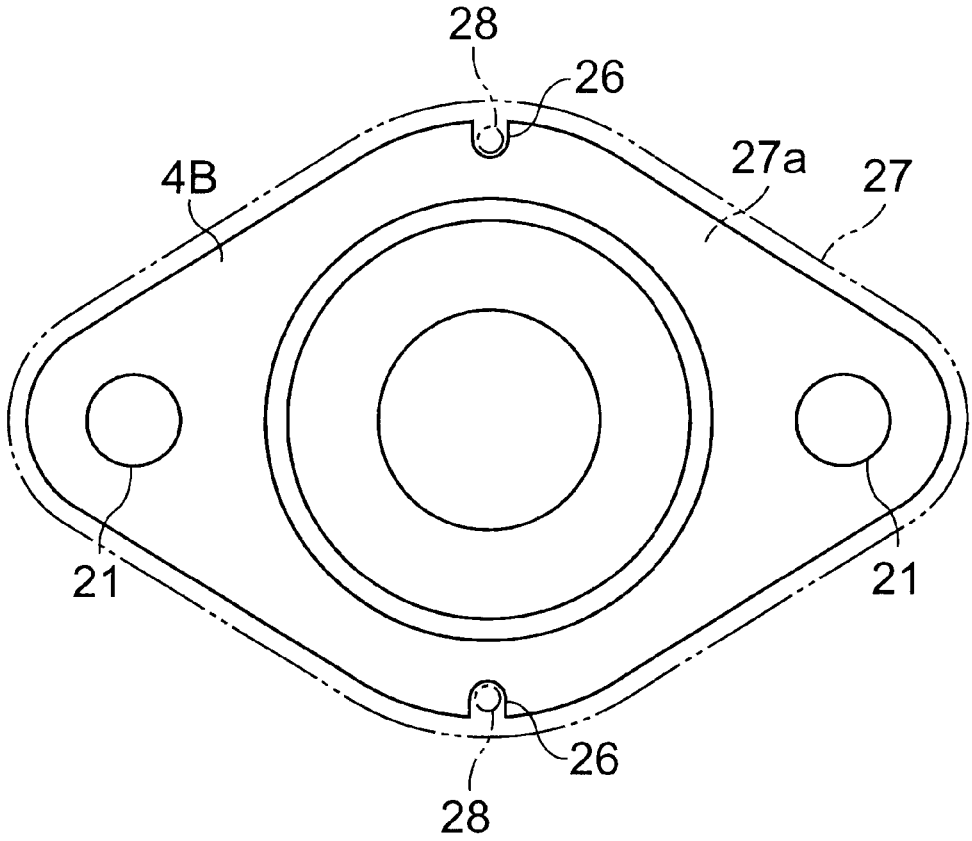
FIGS. 3 to 8 are plan views respectively showing gas discharge tubes according to the second to seventh embodiments of the present invention.

For example, as shown in FIG. 3, as an example of the positioning reference portion, a pair of notches 26 are formed in a rhombic flange portion 4B to oppose each other, and positioning pins 28 stand upright from a support surface 27*a* of a rhombic stem setting portion 27 to correspond to the respective notches 26. A lamp 1 can be positioned at high precision by increasing the fitting precision between the notches 26 and positioning pins 28. In this case, positioning that maintains the relationship between the pins and notches is enabled. A simple structure wherein merely the notches 26 are formed in the flange portion 4B enables high-precision lamp setting.

Figure 4:
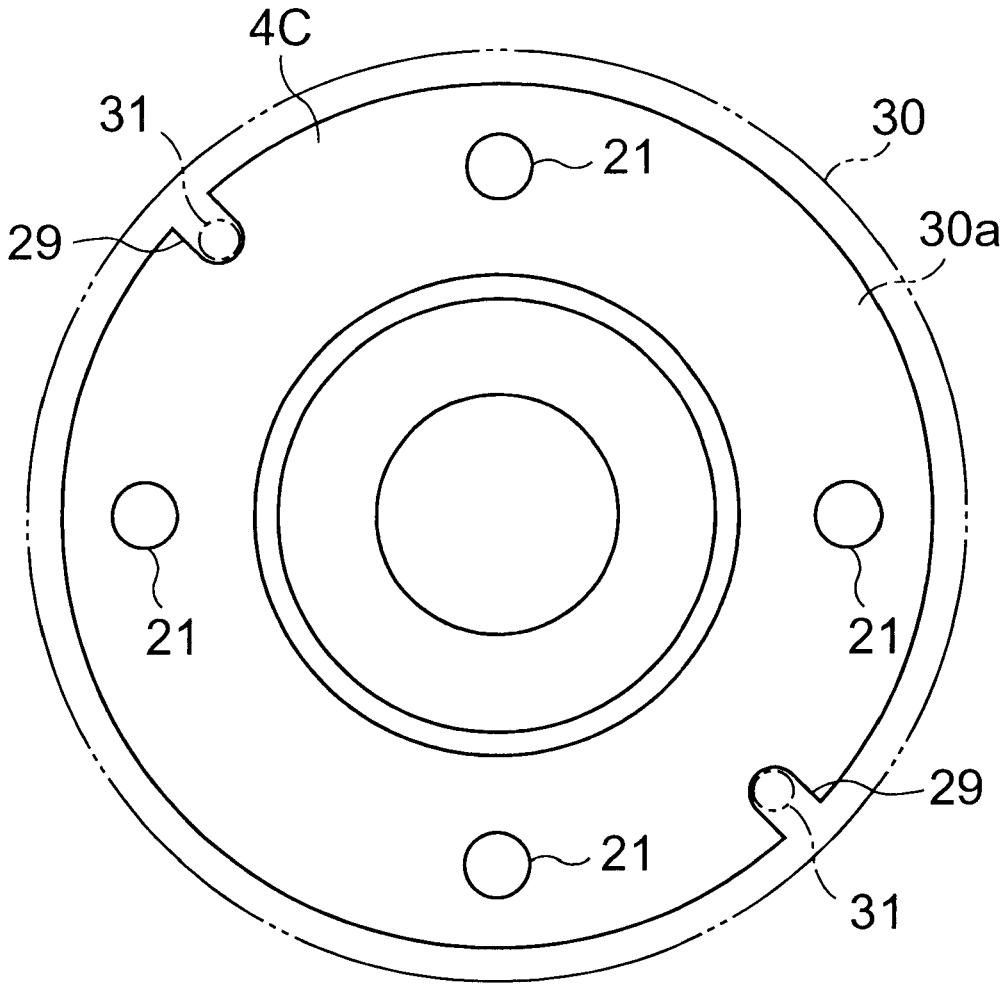

Similarly, as shown in FIG. 4, notches 29 are formed in a circular flange portion 4C to oppose each other so as to fit with positioning pins 31. The bottom surface of the flange portion 4C is set on a support surface 30*a* of a circular stem setting portion 30.

Figure 5:
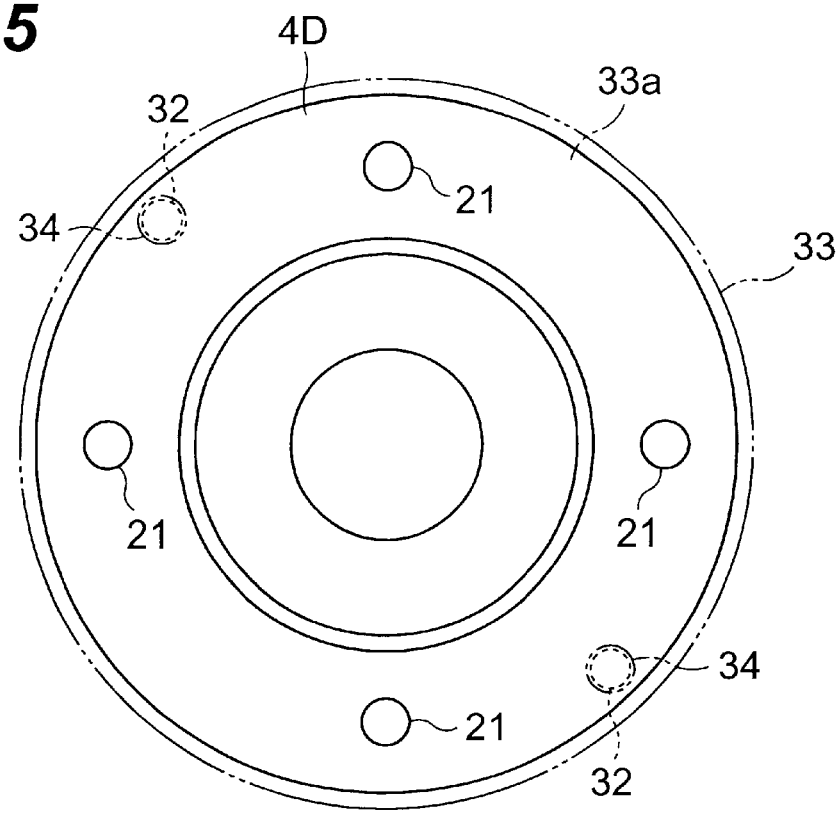

As shown in FIG. 5, as an example of the positioning reference portion, a pair of positioning pins 32 extend upright from the bottom surface of a circular flange portion 4D to oppose each other, and positioning holes 34 are formed in a support surface 33*a* of a circular stem setting portion 33 to correspond to the respective positioning pins 32. A lamp 1 can be positioned at high precision by increasing the fitting precision between the positioning pins 32 and positioning holes 34. In this case, positioning that maintains the relationship between the pins and notches is enabled. A simple structure wherein merely the positioning pins 32 are formed on the flange portion 4D enables highly precise lamp setting.

Figure 6:
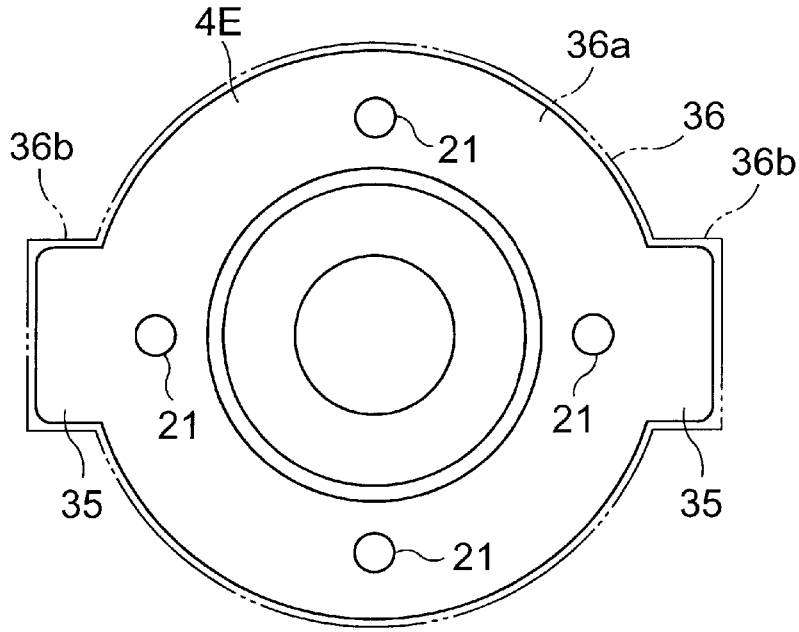

As shown in FIG. 6, as an example of the positioning reference portion, a pair of positioning reference projections 35 are formed on a circular flange portion 4E to extend laterally, and accommodating portions 36*b* conforming to the shapes of the positioning reference projections 35 are formed in a circular stem setting portion 36 to correspond to the respective positioning reference projections 35. A lamp 1 can be positioned at high precision by increasing the fitting precision between the positioning reference projections 35 and accommodating portions 36*b*. The contact area of the flange portion 4E with respect to a support surface 36*a* is accordingly increased, so that the heat sink function of the stem 4 is improved.

Figure 7:
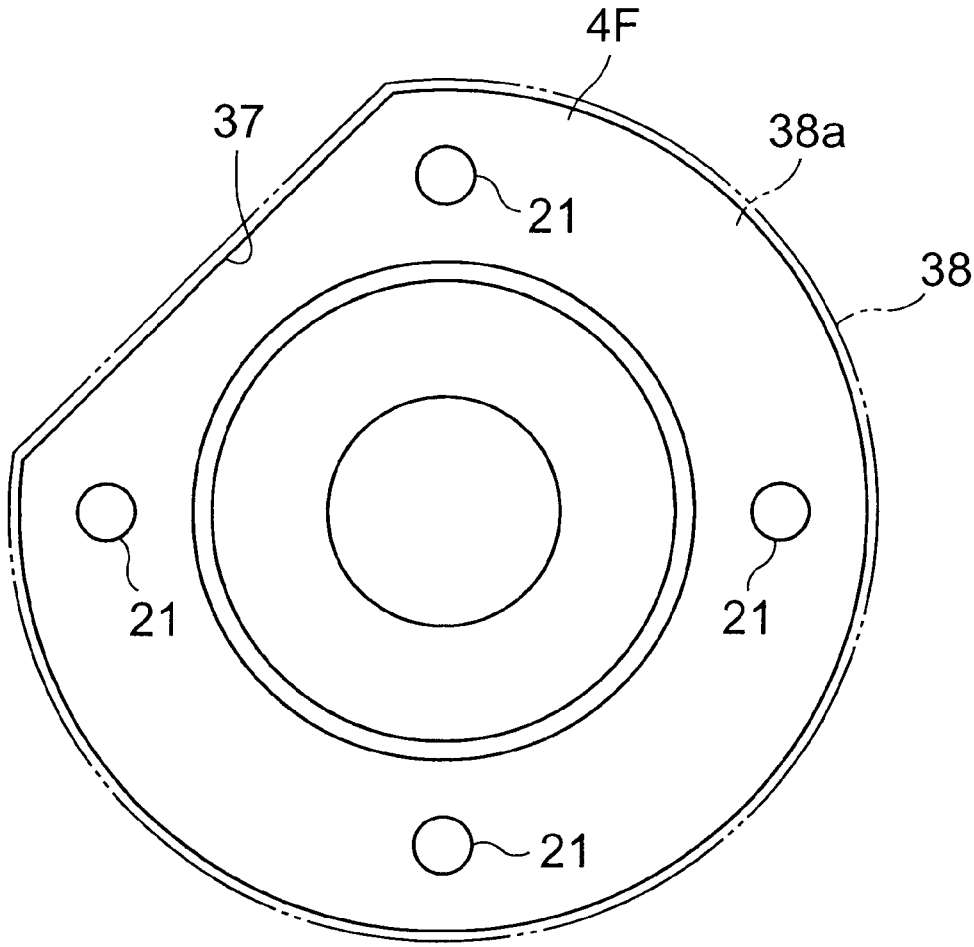

As shown in FIG. 7, as an example of the positioning reference portion, a cut-off portion 37 is formed in a circular flange portion 4F, and a circular stem setting portion 38 has a shape conforming to the outer shape of the cut-off portion 37 so as to correspond to the arcuate cut-off portion 37. High-precision positioning is enabled by only placing the flange portion 4F on a support surface 38*a*.

Figure 8:
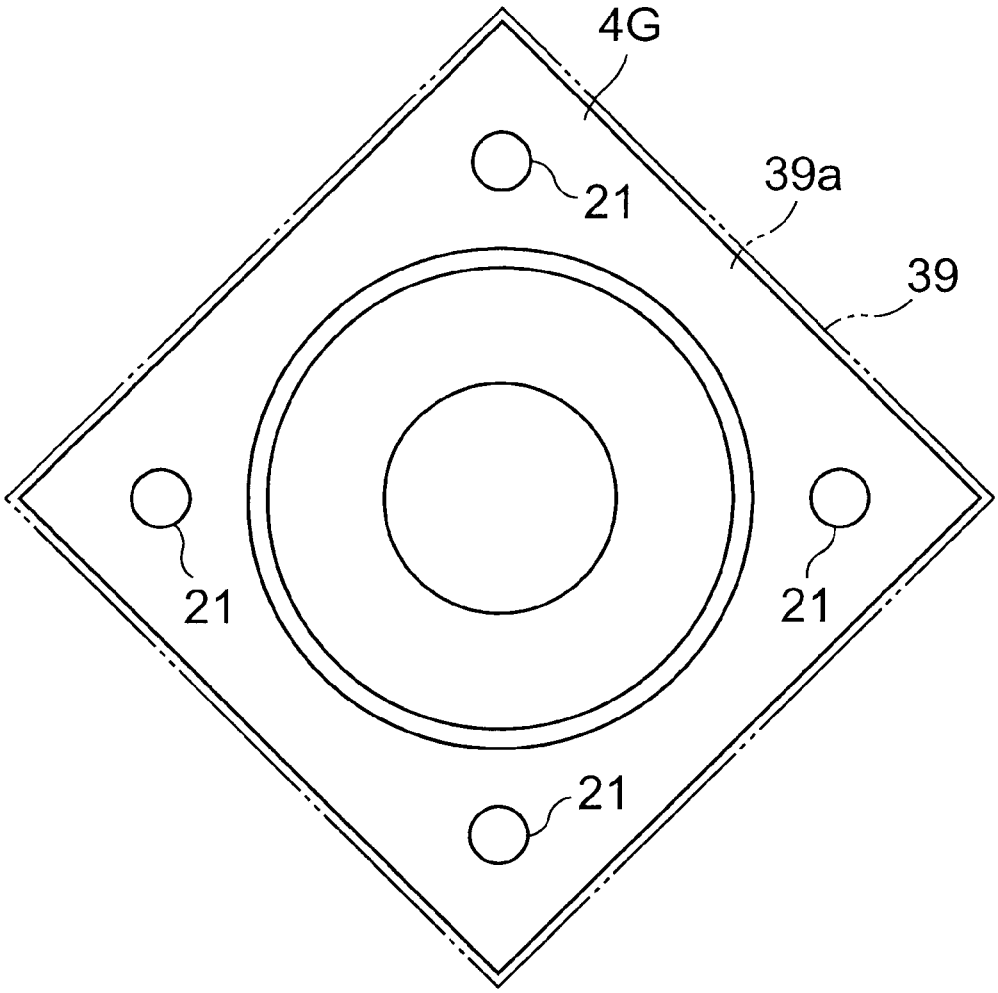
Figure 9:
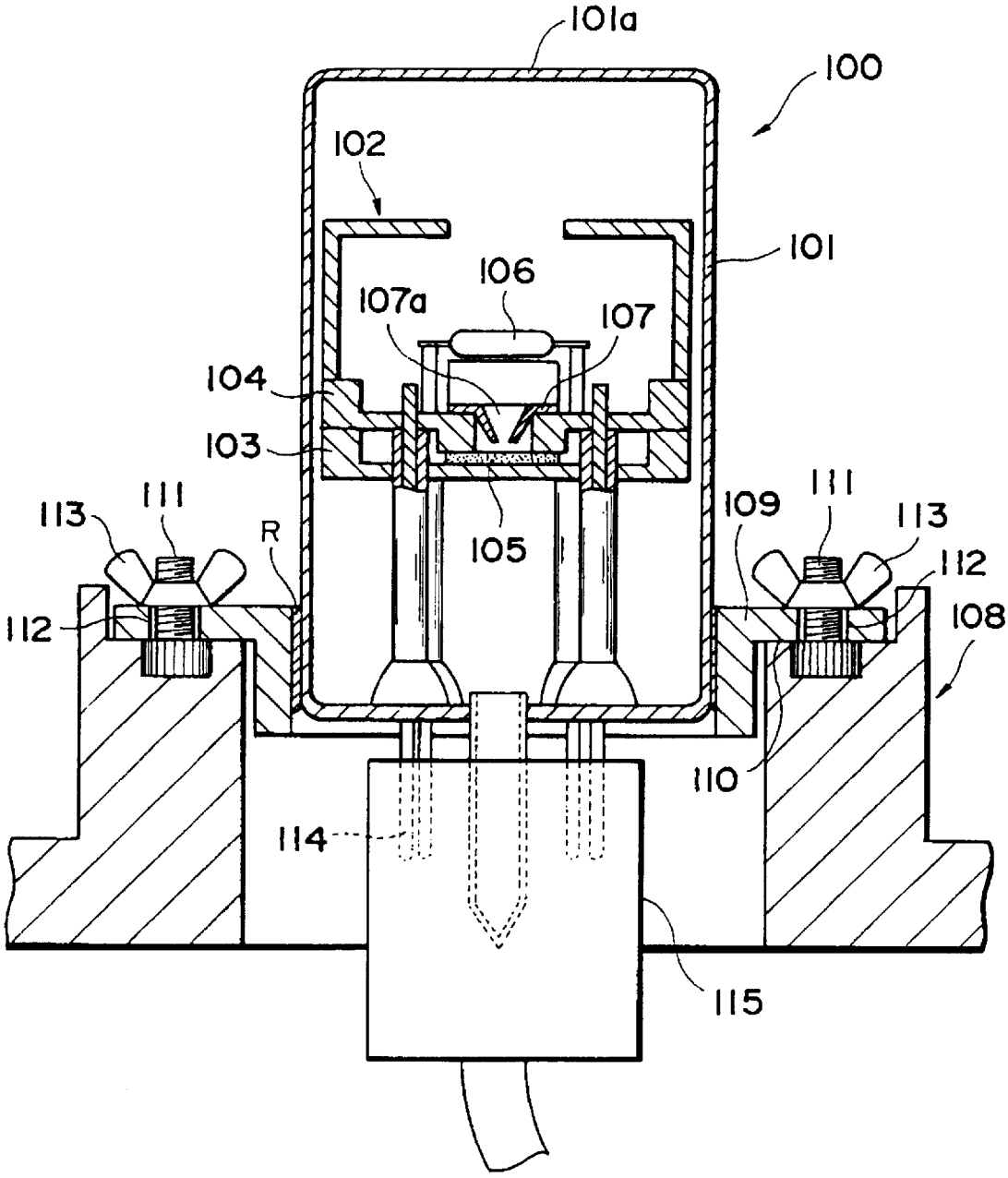
FIG. 9 is a sectional view showing a conventional gas discharge tube.

As shown in FIG. 8, a flange portion 4G has a square outer shape as an example of the positioning reference portion, and a stem setting portion 39 has a shape conforming to the outer shape of the flange portion 4G. High-precision positioning is enabled by only placing the flange portion 4G on a square support surface 39*a*. The outer shape of the flange portion 4G can be any polygonal shape and is not limited to a shape of a regular triangle or regular hexagon.

Since the gas discharge tube according to the present invention has the above arrangement, the assembling workability and the attaching precision with respect to the stem setting portion of the opposite part are improved.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

The present invention can be suitably applied to a gas discharge tube, particularly a deuterium lamp utilized as a light source for a spectrophotometer or chromatography.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A gas discharge tube having a sealed envelope at least a part of which transmits light, said sealed envelope being filled with a gas and being provided with anode and cathode sections disposed therein, electric discharge being generated between said anode and cathode sections, so that the light-transmitting part of said sealed envelope emits predetermined light outside, said sealing envelope comprising:

a stem for securing said cathode and anode section by way of respective stem pins independent from each other; and a side tube, at least part of which is made of a light transmitting material, surrounding said cathode and anode sections and being joined to said stem, and wherein said stem has an integrally formed flange portion extending in a direction perpendicular to an axial direction of said side tube and having a positioning reference portion when attaching said gas discharge tube to an external fixing member.

2. A gas discharge tube according to claim 1, wherein said positioning reference portion has a positioning hole or notch for inserting a positioning pin inserted another end in a positioning hole formed in a stem setting portion of an external fixing member where said gas discharge tube is to be attached, or inserting a positioning pin standing upright from said stem setting portion.

3. A gas discharge tube according to claim 1, wherein said positioning portion has a projecting portion projecting from said flange portion laterally, or a cut-off portion formed on an outer surface of said flange portion so as to conform to a shape of a stem setting portion of said external fixing member to which said gas discharge tube is to be mounted.

4. A gas discharge tube according to claim 1, wherein said flange portion has an outer shape of a predetermined polygon.

5. A gas discharge tube according to claim 1, further comprising:

an anode support plate in contact with a surface of said stem which is inside said sealing envelope, and supporting said anode section on an opposite surface thereof;

a ceramic spacer in contact with an exposed surface of said anode support plate and having an opening for exposing said anode section therethrough; and a ceramic spacer in contact with an exposed surface of said anode support plate and having an opening for exposing said anode section therethrough; and a converging electrode plate in contact with said exposed surface of said spacer to oppose said anode section having a converging opening coaxial with said opening of said spacer, said converging electrode plate being made of a conductive member.

6. A gas discharge tube according to claim 5, wherein said positioning reference portion has a positioning hole or notch for inserting a positioning pin inserted another end in a positioning hole formed in a stem setting portion of an external fixing member where said gas discharge tube is to be attached, or inserting a positioning pin standing upright from said stem setting portion.

7. A gas discharge tube according to claim 5, wherein said positioning portion has a projecting portion projecting from said flange portion laterally, or a cut-off portion formed on an outer surface of said flange portion so as to conform to a shape of a stem setting portion of said external fixing member to which said gas discharge tube is to be mounted.

8. A gas discharge tube according to claim 5, wherein said flange portion has an outer shape of a predetermined polygon.

9. A gas discharge tube according to claim 1, wherein said integrally formed flange portion extends horizontally in the direction perpendicular to the axial direction of said side tube.

10. A gas discharge tube according to claim 1, wherein said side tube is made entirely of light transmitting material.

* * * * *

UNITED STATES PATENT AND TRADEMARK OFFICE

CERTIFICATE OF CORRECTION

PATENT NO. : 6,741,036 B1
DATED : May 25, 2004
INVENTOR(S) : Tomoyuki Ikedo et al.

It is certified that error appears in the above-identified patent and that said Letters Patent is hereby corrected as shown below:

Column 7,
Line 17, delete “section” and insert -- sections --.

Column 8,
Lines 10-12, delete in their entirety.

Signed and Sealed this

Thirteenth Day of July, 2004

JON W. DUDAS
*Acting Director of the United States Patent and Trademark Office*